US009957017B2

(12) United States Patent
Su

(10) Patent No.: US 9,957,017 B2
(45) Date of Patent: May 1, 2018

(54) EXPANDABLE FLOATING STRUCTURE

(71) Applicant: TMT PTE. LTD., Alexandra Terrace (SG)

(72) Inventor: Hsin Chi Su, Taipei (TW)

( * ) Notice: Subject to any disclaimer, the term of this patent is extended or adjusted under 35 U.S.C. 154(b) by 0 days. days.

(21) Appl. No.: 15/030,857

(22) PCT Filed: Oct. 21, 2013

(86) PCT No.: PCT/SG2013/000454
§ 371 (c)(1),
(2) Date: Apr. 20, 2016

(87) PCT Pub. No.: WO2015/060783
PCT Pub. Date: Apr. 30, 2015

(65) Prior Publication Data

US 2016/0272283 A1 Sep. 22, 2016

(51) Int. Cl.

| | |
|---|---|
| ***B63H 25/42*** | (2006.01) |
| ***B63B 35/44*** | (2006.01) |
| ***B63B 39/00*** | (2006.01) |
| ***B63H 11/02*** | (2006.01) |
| *B63B 35/50* | (2006.01) |
| *B63H 11/00* | (2006.01) |

(52) U.S. Cl.
CPC ..... *B63B 35/44* (2013.01); *B63B 39/00* (2013.01); *B63H 11/02* (2013.01); *B63H 25/42* (2013.01); *B63B 35/50* (2013.01); *B63B 2035/446* (2013.01); *B63B 2035/4426* (2013.01); *B63B 2035/4453* (2013.01); *B63H 2011/008* (2013.01)

(58) Field of Classification Search
CPC ... B63B 35/44; B63B 39/00; B63B 2035/446; B63B 2035/4453; B63B 35/50; B63B 2035/4426; B63H 11/02; B63H 25/42; B63H 2011/008
See application file for complete search history.

(56) References Cited

U.S. PATENT DOCUMENTS 1,753,399 A * 4/1930 Blair ..... B63B 35/50 114/261
6,196,151 B1 * 3/2001 Grant ..... B63B 27/143 114/261

* cited by examiner

*Primary Examiner* — Anthony D Wiest
(74) *Attorney, Agent, or Firm* — Robert C. Kowert; Meyertons, Hood, Kivlin, Kowert & Goetzel, P.C.

(57) ABSTRACT

The present invention relates broadly to a floating structure and more particular to a floating structure formed by a plurality of modular floating units, a method for forming a floating structure, and a method for stabilising a plurality of modular floating units lined abreast. The method for forming a floating structure comprises providing a plurality of modular floating units including three or more tunnel thrusters; aligning the plurality of modular floating units wherein each of the three or more tunnel thrusters of each of the plurality of modular floating units are aligned to each of a corresponding three or more tunnel thrusters on an adjacent modular floating unit; and operating at least one of the three or more tunnel thrusters of each of the plurality of modular floating units to generate at least one horizontal pillar of water flow, wherein the at least one horizontal pillar of water flow skewers each of the plurality of modular floating units longitudinally through one of the three or more tunnel thrusters thereof.

19 Claims, 8 Drawing Sheets

EXPANDABLE FLOATING STRUCTURE

TECHNICAL FIELD

The present invention relates broadly to a floating structure and more particular to a floating structure formed by a plurality of modular floating units, a method for forming a floating structure, and a method for stabilising a plurality of modular floating units lined abreast.

BACKGROUND

Offshore floating structures have been widely discussed in the literatures of the maritime industry. Numerous uses for offshore floating structures such as floating airports, floating wind/solar power plants, floating industrial facilities, floating habitation facilities, etc. have been proposed or discussed. However currently, only the offshore oil and gas industry has widely implemented the use of offshore floating structures. The offshore floating structures in the offshore oil and gas industry are generally in the form of Tension Leg Platform, Semi-submersible platform, Truss Spar platform or Floating Production Storage and Offloading (FPSO) unit.

Other than the FPSO units, which are typically floating structures converted from oil tankers, the other types of floating structures are usually customized platforms specially designed and built for the purpose. Further, these platforms are generally moored to the seabed via complex mooring systems.

Current conventional technology in designing and building offshore floating structures are mostly based on the above customized design concept, where floating structures are designed and built for a specific purpose. However, these custom built structures can be costly and the design may be complex, thus inhibiting the expansion of the usage of offshore floating structures into other areas as discussed in the various literature of the maritime industry. The FPSO design, which only involves the conversion of an oil tanker to a floating structure, can be relatively cheaper and easier to implement. However, a single vessel may not provide sufficient space for the other usages proposed in the literature. Further, a single moored converted vessel may be subject to environmental forces such as wind or tidal currents resulting in the rolling, pitching and yawing of the vessel. This may render the single moored converted vessel unsuitable for the other uses as mentioned above.

A need therefore exist to provide solutions that seek to address at least some of the above problems hindering the expansion of the usage of floating structures in other areas.

SUMMARY

In accordance with the first aspect of the present invention, there is provided a method for forming a floating structure, the method comprising providing a plurality of modular floating units including three or more tunnel thrusters; aligning the plurality of modular floating units wherein each of the three or more tunnel thrusters of each of the plurality of modular floating units are aligned to each of a corresponding three or more tunnel thrusters on an adjacent modular floating unit; and operating at least one of the three or more tunnel thrusters of each of the plurality of modular floating units to generate at least one horizontal pillar of water flow, wherein the at least one horizontal pillar of water flow skewers each of the plurality of modular floating units longitudinally through one of the three or more tunnel thrusters thereof.

The step of aligning the plurality of modular floating units may further comprise aligning the plurality of modular floating units by adjusting draft and trim of each of the plurality of modular floating units via ballast means; and aligning the plurality of modular floating units by maneuvering each of the plurality of modular floating units via propulsion means.

The step of aligning the plurality of modular floating units may further comprise the step of monitoring the position and orientation of each of the plurality of modular floating units via position monitoring means.

The step of aligning the plurality of modular floating units may further comprise the step of controlling and monitoring the ballast means, the propulsion means and the position monitoring means of the plurality of modular floating units via a centralized control means.

The step of controlling and monitoring may further comprise communicating between the ballast means, the propulsion means and the position monitoring means of the plurality of modular floating units and the centralized control means via communications means.

The step of aligning the plurality of modular floating units may further comprise the step of determining the amount of ballasting and maneuvers required for aligning the tunnel thrusters via computerized means.

The step of operating at least one of the three or more tunnel thrusters to generate at least one horizontal pillar of water flow may further comprise the step of first starting at least one of the three or more tunnel thrusters of a modular floating unit on one end of the floating structure, subsequently starting a corresponding one of the three or more tunnel thrusters on an adjacent modular floating unit, and continue starting corresponding ones of the three or more tunnel thrusters on the following adjacent modular floating units until all the corresponding ones of the three or more tunnel thrusters on all the modular floating units are started, wherein the pillar of water flow generated by the corresponding ones of the three or more tunnel thrusters skewers each of the plurality of modular floating units.

The step of operating at least one of the three or more tunnel thrusters to generate at least one horizontal pillar of water flow may further comprise synchronizing the corresponding ones of the three or more tunnel thrusters of the plurality of modular floating units generating the horizontal pillar of water flow to operate substantially at the same water flow rate.

The method for forming a floating structure may further comprise the step of mooring one of the plurality of modular floating units.

The method for forming a floating structure may further comprise the step of configuring the plurality of modular floating units for use as a single floating structure.

According to a second aspect of the present invention, there is provided a floating structure comprising a plurality of modular floating units, and wherein the plurality of modular floating units include three or more tunnel thrusters, and wherein the three or more tunnel thrusters of each of the plurality of modular floating units are aligned to the corresponding three or more tunnel thrusters of an adjacent modular floating unit.

The plurality of modular floating units may further comprise ballast means for adjusting the draft and trim of the plurality of modular floating units; and propulsion means for maneuvering the plurality of modular floating units.

The plurality of modular floating units may further comprise position monitoring means for monitoring the position of the plurality of modular floating units.

The floating structure may further comprise centralized control means for centralized controlling and monitoring of the ballast means, the propulsion means and the position monitoring means.

The floating structure may further comprise communication means for communicating between the centralized control means and each of the plurality of modular floating units.

At least one of the plurality of modular floating units may further comprises a offshore mooring system.

According to a third aspect of the present invention, there is provided a method for stabilising a plurality of modular floating units lined abreast, the method comprising generating at least one horizontal pillar of water flow for connecting the plurality of modular floating units, wherein the pillar of water flow skewers each of the plurality of modular floating units.

The method for stabilising a plurality of modular floating units lined abreast may further comprise turning the plurality of floating units to a favourable orientation taking into consideration the prevailing wind, current and weather conditions, and maintaining the plurality of floating units in the favourable orientation.

The step of maintaining the plurality of floating units may further comprise generating a first horizontal pillar of water flow near a bow of each of the plurality of modular floating units, generating a second horizontal pillar of water flow substantially in a midship of each of the plurality of modular floating units, and generating a third horizontal pillar of water flow near a stern of each of the plurality of modular floating units, and wherein the first and the third horizontal pillar of water flow are in the same direction, and wherein the second horizontal pillar of water flow is in an opposite direction from the first and the third horizontal pillar of water flow.

BRIEF DESCRIPTION OF THE DRAWINGS

Embodiments of the invention will be better understood and readily apparent to one of ordinary skill in the art from the following written description, by way of example only, and in conjunction with the drawings, in which.

DETAILED DESCRIPTION

A floating structure according to embodiments of the present invention is based on converting existing vessels or building new vessels/barges for use in forming a modular and expandable floating structure. According to embodiments of the present invention, a stable and large floating structure may be formed by the configurations and methods as described herewith.

Figure 1:
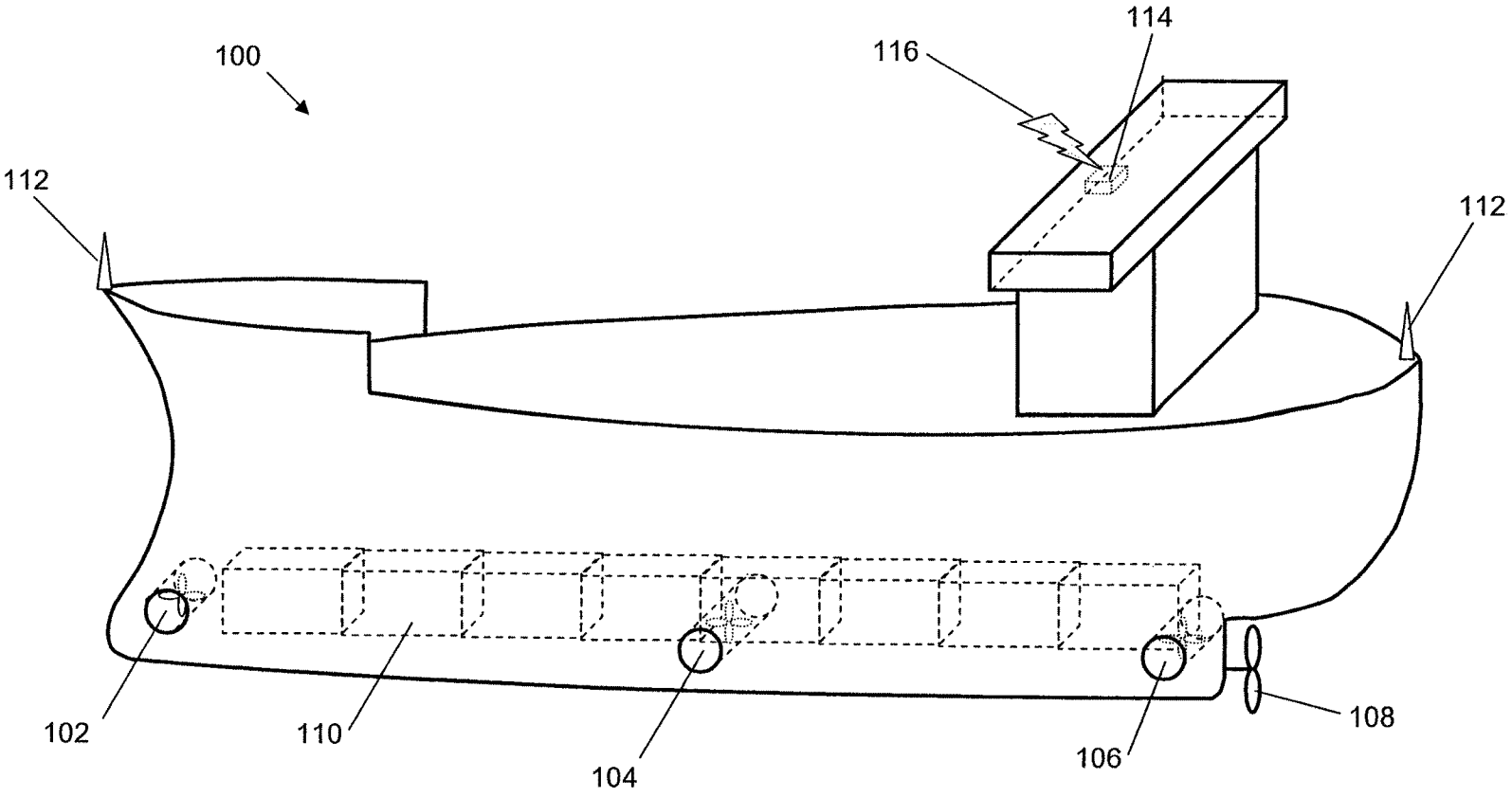
FIG. 1 shows a perspective view of a modular floating unit of a floating structure according to an example embodiment of the present invention.

FIG. 1. shows a perspective view of a modular floating unit 100 of a floating structure according to an embodiment of the present invention. The modular floating unit 100 of the floating structure as shown in FIG. 1 is in the shape of a vessel. The modular floating unit 100 of the floating structure may be an existing vessel converted to be used or new vessels built for use to form the floating structure. It is understood that the modular floating unit 100 may also be in the form of floating barges or platforms customized for the purpose.

As shown in FIG. 1, the modular floating unit 100 of the floating structure includes a bow tunnel thruster 102, a midship tunnel thruster 104 and a stern tunnel thruster 106. It is understood that variation in the number and disposition of tunnel thrusters may be possible. FIG. 1 is provided by way of an example only. The tunnel thrusters 102, 104, 106 may be operated and controlled individually such that the modular floating unit 100 may be turned or moved laterally/sideways. For example, when the bow tunnel thruster 102 and the stem tunnel thruster 106 are thrusting in opposite directions, the modular floating unit may be turned. When all the tunnel thrusters 102, 104, 106 are thrusting in the same direction, the modular floating unit may be moved laterally/sideways. When the bow tunnel thruster 102 and stern tunnel thruster 106 are thrusting in the same direction, and the midship tunnel thruster 104 is thrusting in an opposite direction from the bow tunnel thruster 102 and the stem tunnel thruster 106, the modular floating unit 100 may maintain its orientation and position.

Further, as illustrated in FIG. 1, the modular floating unit 100 of the floating structure also includes onboard ballast means 110 for adjusting the draft and trim of the modular floating unit 100 of the floating structure. As shown, the modular floating unit 100 of the floating structure further includes propulsion means 108 for maneuvering the modular floating unit 100. The type of propulsion means 108 may vary. By way of example and not limitation, the propulsion means 108 may be propellers and a rudder system, water-jet system, impeller system, Voith Schneider propeller system, azimuth propulsion system, or any combination thereof.

In addition, the modular floating unit 100 of the floating structure also includes position monitoring means 112 for providing feedback on the position of the modular floating unit 100 of the floating structure. The position monitoring means 112 may be in the form of a Global Positioning System or an Inertia Positioning System. The position monitoring means 112 may provide three dimensional position information or two dimensional position information of each end of the modular floating unit 100. It is understood that the number and variation in the position monitoring means 112 may be possible. For example, it is possible to place the position monitoring means 112 at the respective tunnel thrusters 102, 104 106 to measure and monitor the position of the respective tunnel thrusters 102, 104, 106. FIG. 1. is provided by way of an example only.

The tunnel thrusters 102, 104, 106, the ballast means 110, the propulsion means 108 and the position monitoring means 112 may be locally controlled and monitored at the respective locations onboard the modular floating unit 100. They may also be remotely controlled and monitored via a remote control means 114. The remote control means 114 may be located in the engine control room or in the bridge of the modular floating unit 100. In FIG. 1, the remote control means 114 is shown to be located in the bridge of the modular floating unit 100. FIG. 1 is provided by way of an illustration only.

The remote control means 114 may control and monitor the tunnel thrusters 102, 104, 106, the ballast means 110, the propulsion means 108 and the position monitoring means 112 via communication means 116. The communication means 116 may be in the form of wired/cable communication or wireless communication.

In an example embodiment, the tunnel thrusters 102, 104, 106, the ballast means 110, the propulsion means 108 and the position monitoring means 112 may be directly connected via wired communication or wireless communication to the remote control means 114. An operator operating the remote control means 114 at the location of the remote control means 114 may be able to remotely control and monitor the tunnel thrusters 102, 104, 106, the ballast means 110, the propulsion means 108 and the position monitoring means 112.

In another example embodiment, a local operator may be locally operating each of the tunnel thrusters 102, 104, 106, the ballast means 110, the propulsion means 108 and the position monitoring means 112. A remote operator operating at the remote control means 114 may control and monitor the tunnel thrusters 102, 104, 106, the ballast means 110, the propulsion means 108 and the position monitoring means 112 by communicating with the local operator via walkie talkie or any other communication devices.

It is understood that variation in the method and configuration for the communication means 116 may be possible. The examples described above are provided by way of an example and not limitation.

Figure 2:
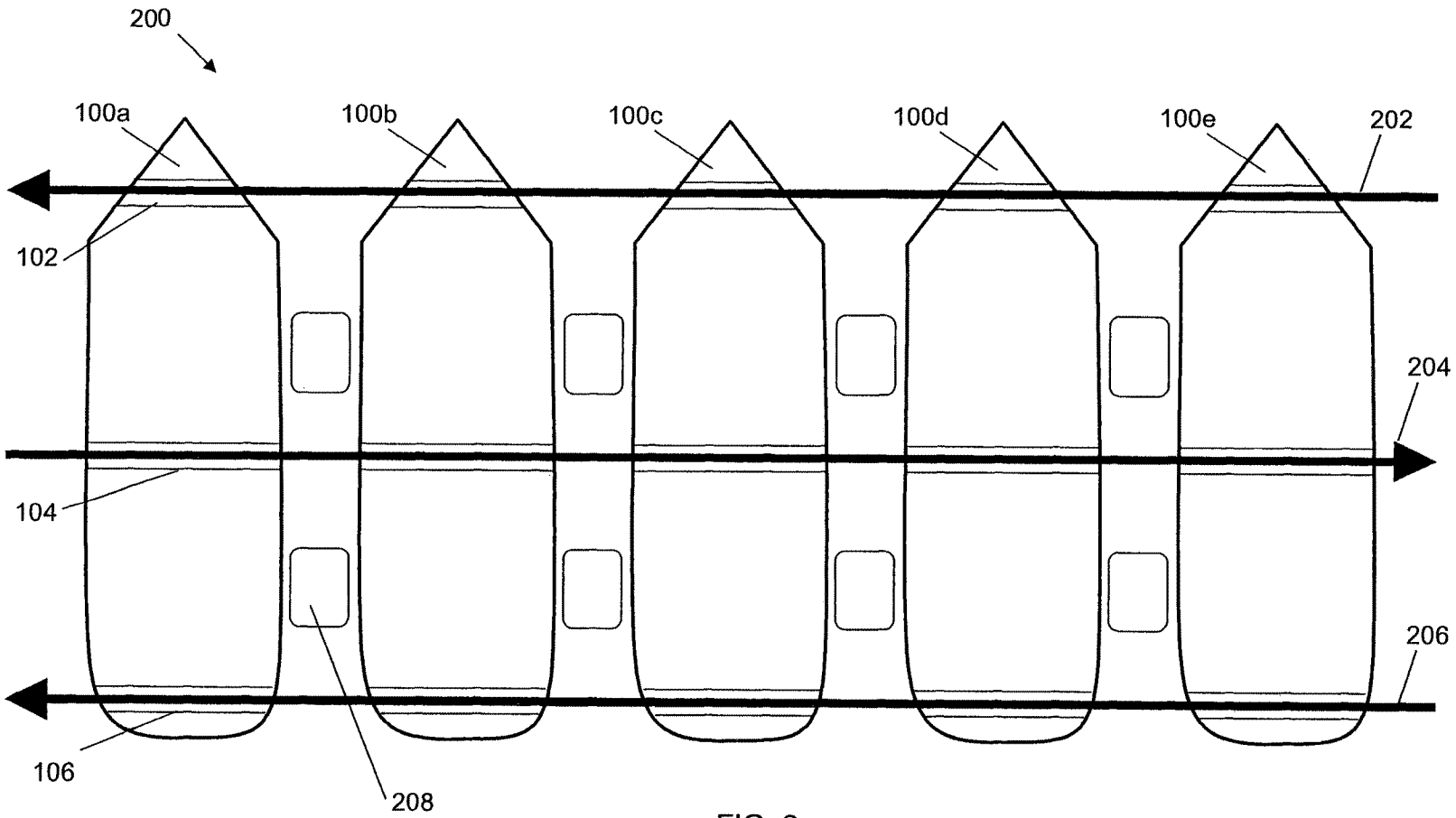
FIG. 2 shows a top view of a floating structure according to an example embodiment of the present invention.

FIG. 2 shows a top view of a floating structure 200 according to an embodiment of the present invention. As shown in FIG. 2, the floating structure 200 is formed by a plurality of modular floating units 100*a-e* lined abreast and spaced apart by fenders 208. Fenders 208 may be placed in between the modular floating units 100*a-e* to function as a cushion or force absorber. The modular floating units 100*a-e* may be similar in dimensions, tonnages and hull shape. It is understood that variation in the number, dimensions and shape of the modular floating units 100*a-e* may be possible. It is also understood that variation in the size, shape, disposition, number and material of the fenders 208 may be possible. Further, the distance apart between each of the plurality of modular floating units 100*a-e* and the type of fenders 208 to be used may vary depending on the size of the modular floating units 100*a-e*. Standard maritime practice may be adopted to determine the distance apart and the type of fenders 208 to be used. FIG. 2 is provided by way of an example only.

Each of the plurality of modular floating units 100*a-e* in the floating structure 200 may include three or more tunnel thrusters. As depicted in FIG. 2, in this embodiment, the plurality of modular floating units 100*a-e* include three tunnel thrusters 102, 104, 106. To form the floating structure 200, each of the plurality of modular floating units 100*a-e* is aligned such that each of the three tunnel thrusters 102, 104, 106 of each of the plurality of modular floating units 100*a-e* are aligned to each of the corresponding three tunnel thrusters 102, 104, 106 on an adjacent modular floating unit 100*a-e*. Therefore, in the floating structure 200 formed in accordance with this embodiment, the plurality of the modular floating units 100*a-e* are aligned such that, all the respective tunnel thrusters 102, 104, 106 of each of the plurality of modular floating unit 100*a-e* are aligned.

After aligning the plurality of modular floating units 100*a-e*, the plurality of modular floating units 100*a-e* may be connected by generating at least one horizontal pillar of water flow 202, 204, 206, which runs through a series of one of the three aligned tunnel thrusters 102, 104, 106, such that the at least one horizontal pillar of water flow 202, 204, 206 skewers each of the plurality of modular floating units 100*a-e* longitudinally along the longitudinal axis of the tunnel thrusters 102, 104, 106. The at least one horizontal pillar of water flow 202, 204, 206 may be generated by operating at least one of the three tunnel thrusters 102, 104, 106 of each of the plurality of modular floating units 100*a-e*.

In FIG. 2, all the three tunnel thrusters 102, 104, 106 of each of the plurality of modular floating units 100*a-e* are illustrated to be operated to generate three horizontal pillars of water flow 202, 204, 206, which run through a series of aligned tunnel thrusters 102, 104, 106 of the plurality of modular floating units 100*a-e*, such that three horizontal pillars of water flow 202, 204, 206 skewer each of the plurality of modular floating units 100*a-e* longitudinally along the longitudinal axis of the tunnel thrusters 102, 104, 106. It is understood that variation in the number and direction of the horizontal pillar of water flow 202, 204, 206 may be possible.

The advantages of connecting the plurality of modular floating units 100*a-e* via a horizontal pillar of water flow 202, 204, 206 is that the floating structure 200 may be stabilized. In this example embodiment, with the horizontal pillar of water flow 202, 204, 206 skewering and connecting each of the plurality of modular floating units 100*a-e*, the floating structure 200 formed may become substantially rigid and may react to the prevailing wind, current or weather substantially as a single floating structure. Therefore, an advantage of the present invention is that a large, stable, configurable, expandable floating structure may be provided by using the plurality of floating structure 100*a-e*. In contrast, if the plurality of modular floating units 100*a-e* are connected merely by lines, which is known in the current art, each of the plurality of modular floating units 100*a-e* will react to the prevailing wind, current or weather as an independent vessel. This means that each of the plurality of modular floating units 100*a-e* will roll, pitch or yaw individually at different rate and degree in response to the prevailing wind, current and weather, thus rendering a plurality of modular floating units 100*a-e* connected by way of lines not suitable for forming a single floating structure.

However, in this example embodiment, loose line may still be tied between the plurality of modular floating units 100*a-e* in accordance with the standard practice of seamanship as a back up to keep the plurality of modular floating units 100*a-e* substantially together in case of temporary malfunction of any of the tunnel thrusters 102, 104, 106.

It is also advantageous that embodiments of the present invention include three or more tunnel thrusters. Generally, a conventional vessel has either a bow tunnel thruster or a stern tunnel thruster or both. These tunnel thrusters are typically used for assisting the vessel in turning, especially when the vessel is going alongside a dock or when turning in slow speed. Generally one or two tunnel thrusters are sufficient to fulfill the turning requirement. Therefore, there is no requirement to install more than two tunnel thrusters on a conventional vessel. However, in embodiments of the present invention, tunnel thrusters 102, 104, 106 are used to generate horizontal pillars of water flow 202, 204, 206 to connect and stabilize a plurality of modular floating units 100. Each horizontal pillar of water flow 202, 204, 206 generated will result in a lateral force acting on the floating structure 200 formed by the plurality of modular floating units 100. If there is only one or two tunnel thrusters, the floating structure 200 formed by the plurality of modular floating units 100 may not be able to balance the forces and would result in the floating structure 200 being set in perpetual turning motion. With three or more tunnel thrusters, the floating structure 200 may be able to balance the forces acting on the floating structure 200 by generating various combinations and configurations of horizontal pillars of water flow 202, 204, 206. The floating structure 200 may also have the flexibility to utilize various configurations and combinations of horizontal pillars of water flow 202, 204, 206 to maneuver the floating structure 200. Therefore, having three or more tunnel thrusters 102, 104, 106 would provide embodiments of the present invention substantial advantages over conventional vessels with one or two tunnel thrusters. Examples of how the floating structure 200 may utilize the various configurations and combinations of horizontal pillars of water flow 202, 204, 206 will be discussed later.

Figure 3:
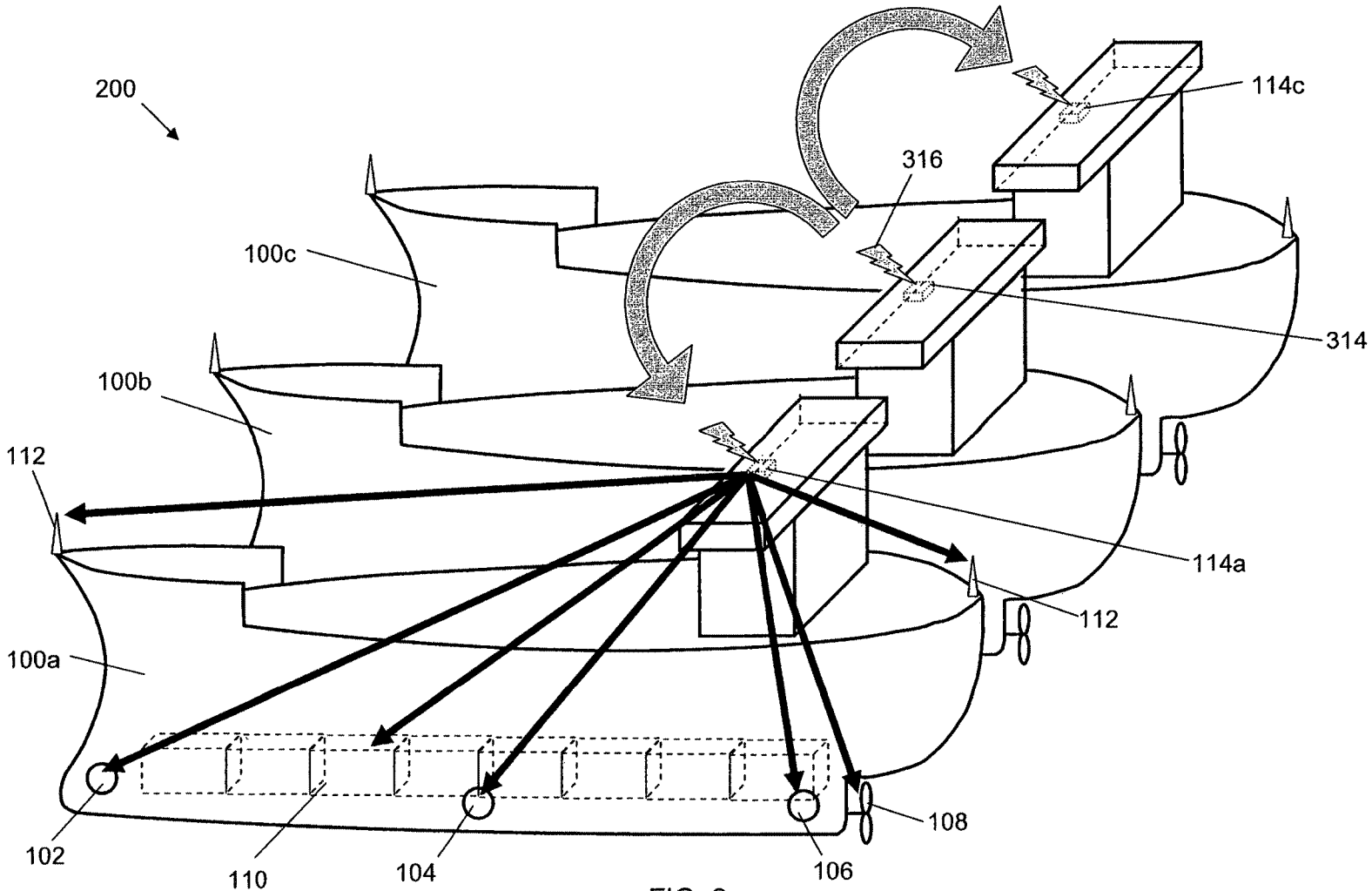
FIG. 3 shows a perspective view of a floating structure according to an example embodiment of the present invention.

FIG. 3 shows a perspective view of a floating structure 200 according to an embodiment of the present invention. To coordinate the alignment of each of the plurality of modular floating units 100*a-c*, the floating structure 200 may include a centralized control means 314 for controlling and monitoring of the ballast means 110, the propulsion means 108 and the position monitoring means 112 of each of the plurality of modular floating units 100*a-c*. The centralized control means 314 may also be used to control and monitor the tunnel thrusters 102, 104, 106 of each of the plurality of modular floating units 100*a-c* for generating a horizontal pillar of water flow 202, 204, 206 as shown in FIG. 2.

As shown in the example embodiment in FIG. 3, the centralized control means 314 is located on a modular floating unit 100*b*. Onboard modular floating unit 100*b*, the centralized control means 314 may also function as a remote control means 114 for modular floating unit 100*b*, similar to the remote control means 114 for each modular floating unit 100 as depicted by FIG. 1. Referring back to FIG. 3, the centralized control means 314 is connected via communication means 316 to the remote control means 114*a*, 114*c* of the other modular floating units 100*a*, 100*c*. The communication means 316 may be in the form of wired/cable communication or wireless communication.

In an example embodiment, the centralized control means 314 may be directly connected to each of the remote control means 114*a*, 114*c* of the other modular floating units 100*a*, 100*c* via wired communication or wireless communication. A central operator, coordinating the alignment of the plurality of modular floating units 100*a-c* or operating the tunnel thrusters 102, 104, 106 of each of the plurality of modular floating units 100*a-c*, may operate the centralized control means 314 at the location of the centralized control means 314 to communicate directly with the remote control means 114*a*, 114*c* to remotely control and monitor the tunnel thrusters 102, 104, 106, the ballast means 110, the propulsion means 108 and the position monitoring means 112 for each of the other modular floating units 100*a*, 100*c*. At the same time, since the centralized control means 314 also act as the remote control means for modular floating unit 100*b*, the central operator could also remotely control and monitor the tunnel thrusters 102, 104, 106, the ballast means 110, the propulsion means 108 and the position monitoring means 112 for modular floating units 100*b*. Therefore, in this example embodiment, the configuration of communication means 316 and full automation of the plurality of the modular floating units 100*a-c* may make it possible for one single central operator to coordinate the alignment of the plurality of modular floating units 100*a-c* or operate the tunnel thrusters 102, 104, 106 of all the modular floating units 100*a-c* to generate a horizontal pillar of water flow 202, 204, 206 as shown in FIG. 2

In another example embodiment, the centralized control means 314 may not be directly connected to each of the remote control means 114*a*, 114*c* of the other modular floating units 100*a*, 100*c*. In this embodiment, a remote operator may be operating at each of the remote control means 114*a*, 114*c* for modular floating units 100*a*, 100*c*. A central operator, coordinating the alignment of the plurality of modular floating units 100*a-c* or operating the tunnel thrusters 102, 104, 106 of each of the plurality of modular floating units 100*a-c*, may communicate with each of the remote operator for each of the other modular floating units 100*a*, 100*c* via walkie talkie or any other communication devices. In this way, the central operator may control and monitor the tunnel thrusters 102, 104, 106, the ballast means 110, the propulsion means 108 and the position monitoring means 112 for each of the other modular floating units 100*a*, 100*c* via communication with the remote operators operating the remote control means 114*a*, 114*c* of each of the other modular floating units 100*a*, 100*c*. At the same time, since the centralized control means 314 also act as the remote control means for modular floating unit 100*b*, the central operator could also remotely control and monitor the tunnel thrusters 102, 104, 106, the ballast means 110, the propulsion means 108 and the position monitoring means 112 for modular floating units 100*b*. Therefore, in this example embodiment, the configuration of communication means 316 and automation of each of the plurality of the modular floating units 100*a-c* may make it possible for one central operator and two remote operator to coordinate the alignment of the plurality of modular floating units 100*a-c* or operate the tunnel thrusters 102, 104, 106 of all the modular floating units 100*a-c* to generate a horizontal pillar of water flow 202, 204, 206 as shown in FIG. 2

Figure 4:
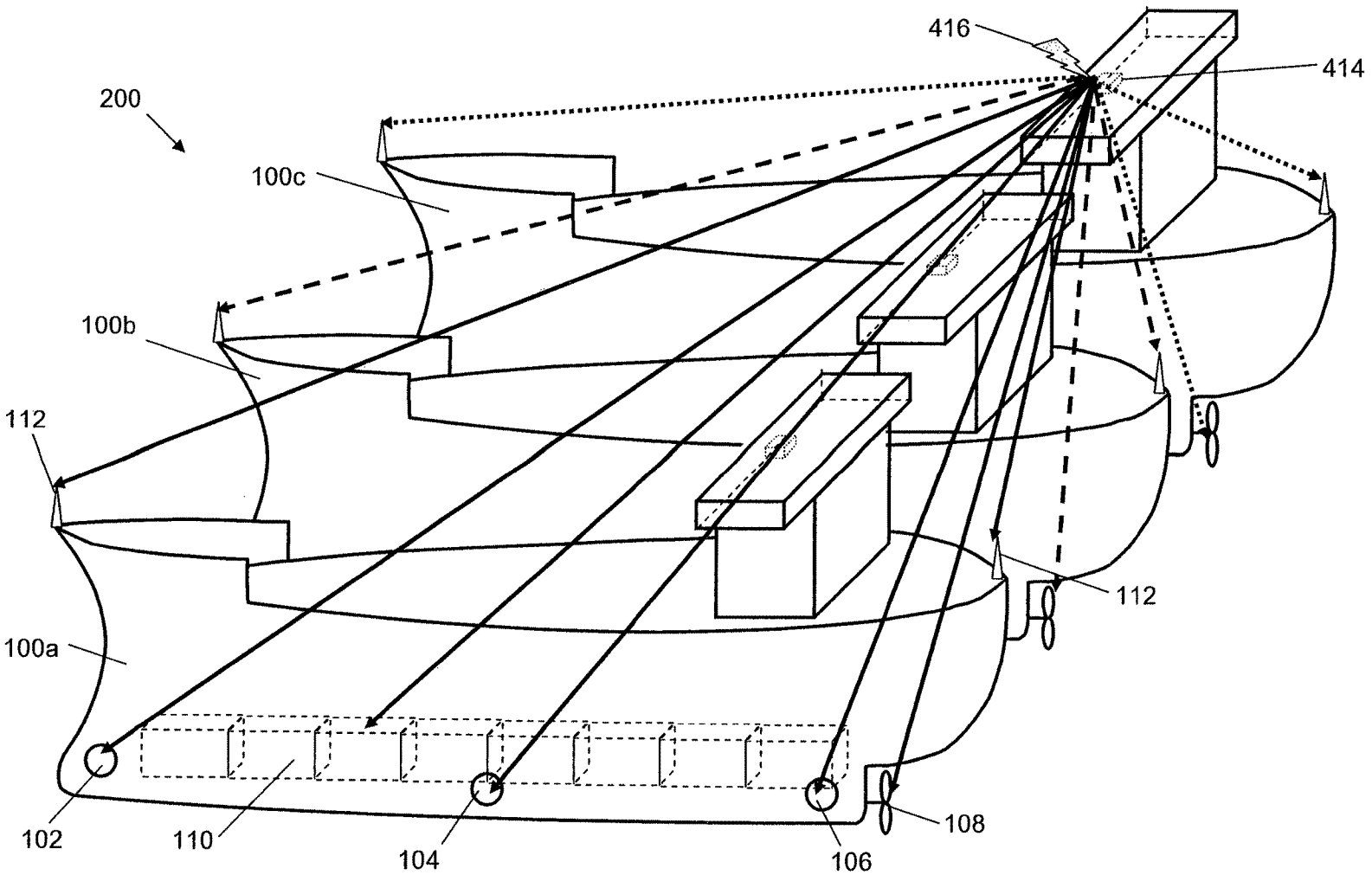
FIG. 4 shows a perspective view of a floating structure according to an example embodiment of the present invention with a different configuration of communication means and centralized control means as shown in FIG. 3.

FIG. 4 shows a perspective view of a floating structure 200 according to an embodiment of the present invention with another configuration of communication means and centralized control means. In this example embodiment, the centralized control means 414 may be directly connected, via wired communication or wireless communication, to each of the tunnel thrusters 102, 104, 106, the ballast means 110, the propulsion means 108 and the position monitoring means 112 for each of the other modular floating units 100*a-c*. The difference between this embodiment and the embodiments shown in FIG. 3 is that in this embodiment, the communication means 416 bypass the remote control means of each of the plurality of modular floating units 100*a-c*. Accordingly, a central operator, coordinating the alignment of the plurality of modular floating units 100*a-c* or operating the tunnel thrusters 102, 104, 106 of each of the plurality of modular floating units 100*a-c*, may operate the centralized control means 414 at the location of the centralized control means 414 and via direct communication link, remotely control and monitor each of the tunnel thrusters 102, 104, 106, the ballast means 110, the propulsion means 108 and the position monitoring means 112 for each of the plurality of modular floating units 100*a-c*. Therefore, in this example embodiment, the configuration of communication means 416 and full automation of the plurality of the modular floating units 100*a-c* may make it possible for one single central operator to coordinate the alignment of the plurality of modular floating units 100*a-c* or operate the tunnel thrusters 102, 104, 106 of all the modular floating units 100*a-c* to generate a horizontal pillar of water flow 202, 204, 206 as shown in FIG. 2

In another example embodiment, the centralized control means, 414 may not be directly connected to the tunnel thrusters 102, 104, 106, the ballast means 110, the propulsion means 108 and the position monitoring means 112 for each of the other modular floating units 100*a-c*. In this embodiment, a local operator may be locally operating each of the tunnel thrusters 102, 104, 106, the ballast means 110, the propulsion means 108 and the position monitoring means 112 of each of the plurality of modular floating units 100*a-c*. A central operator, coordinating the alignment of the plurality of modular floating units 100*a-c* or operating the tunnel thrusters 102, 104, 106 of each of the plurality of modular floating units 100*a-c*, may communicate with each of the local operators onboard each modular floating units 100*a-c* via walkie talkie or any other communication device. In this way, the central operator may control and monitor the tunnel thrusters 102, 104, 106, the ballast means 110, the propulsion means 108 and the position monitoring means 112 for each of the plurality of modular floating units 100*a-c* via communication with the local operators operating onboard each of the plurality of modular floating units 100*a-c*. Therefore, in this example embodiment, it is possible for one central operator and a plurality of local operators to coordinate the alignment of the plurality of modular floating units 100*a-c* or operate the tunnel thrusters 102, 104, 106 of all the modular floating units 100*a-c* to generate a horizontal pillar of water flow 202, 204, 206 as shown in FIG. 2

It is understood that variation in the method, configuration and combination for the communication means 316, 416 may be possible. The examples described above are provided by way of an example and not limitation.

With the floating structure 200 formed, the aligned plurality of modular floating units 100 may be configured to be used as a single floating structure. For example, the plurality of modular floating units 100 of floating structure 200 may be configured to be used as floating terminals, floating airports, floating wind/solar power plants, floating industrial facilities, floating habitation facilities, floating storage facilities, floating military bases etc.

Figure 5:
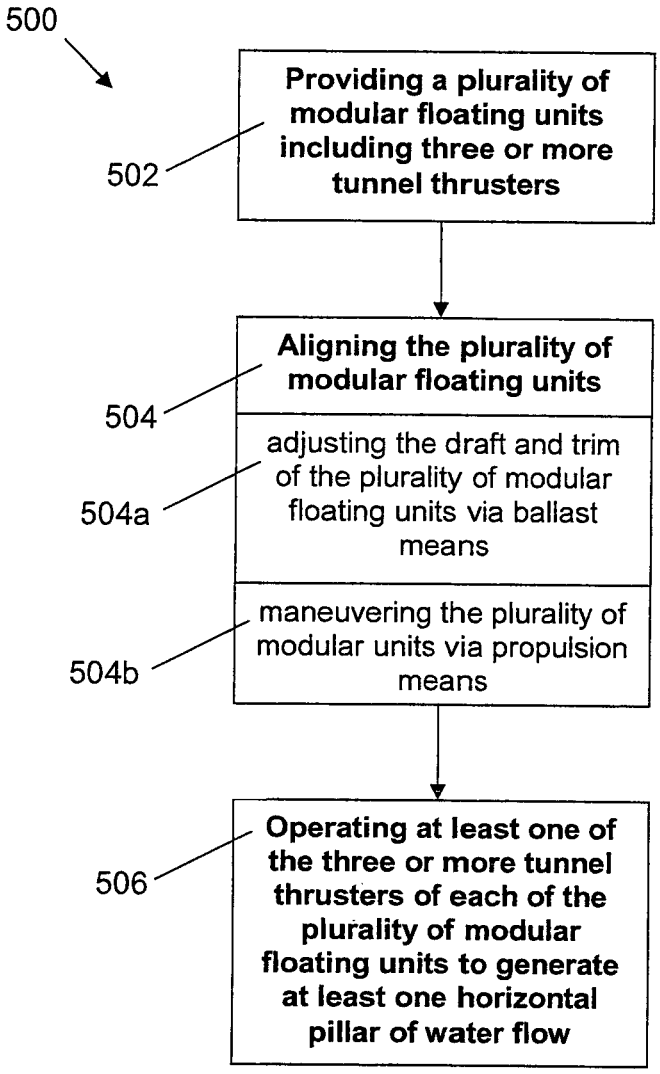
FIG. 5 shows a flow diagram 500 illustrating a method of forming the floating structure 200 shown in FIG. 2.

FIG. 5 shows a flow diagram 500 illustrating a method of forming the floating structure 200 shown in FIG. 2.

In step 502, a plurality of modular floating units 100, as described in FIG. 1, is provided. Each of the plurality of modular floating units 100 may include three or more tunnel thrusters 102, 104, 106, propulsion means 108, ballast means 110, position monitoring means 112, remote control means 114 or centralized control means 314, 414, and communication means 116, 316, 416. In step 502 of providing the plurality of modular floating units 100, each of the plurality of modular floating units 100 may rendezvous in the vicinity of the location where the floating structure 200 is to be formed, such that they are in close proximity to each other. In this way, the plurality of modular floating units 100 may then proceed to the next step 504.

In step 504, the plurality of modular floating units 100 are aligned such that each of the three or more tunnel thrusters 102, 104, 108 of each of the plurality of floating units 100 are aligned to each of a corresponding three or more tunnel thrusters 102, 104, 108 on an adjacent modular floating unit 100. Therefore, in the floating structure 200 formed, the plurality of the modular floating units 100 are aligned such that, all the respective tunnel thrusters 102, 104, 106 of each of the plurality of modular floating unit 100 are aligned.

The step 504 of aligning the plurality of modular floating units 100 may further include the step 504*a* of aligning the plurality of modular floating units 100 by adjusting draft and trim of each of the plurality of modular floating units 100 via ballast means 110, and the step 504*b* of aligning the plurality of modular floating units 100 by maneuvering each of the plurality of modular floating units 100 via propulsion means 108. By adjusting the draft and trim of each of the plurality of modular floating units 100 via ballast means 110, the three or more tunnel thrusters 102, 104, 106 may be aligned such that their longitudinal axis is parallel to the surface plane of the water. Further, by controlling the ballast means 110, the depth of the tunnel thrusters 102, 104, 106 from the surface of the water may also be controlled. By maneuvering each of the plurality of modular floating units 100 via propulsion means 108, the position and orientation of the plurality of modular floating units 100 may be adjusted such that the plurality of the modular floating units 100 may be aligned to be parallel to each other, the respective three or more tunnel thrusters 102, 104, 106 of the plurality of modular floating units 100 may be aligned longitudinally along the longitudinal axis of the three or more tunnel thrusters 102, 104, 106 and the distance apart between the plurality of modular floating units 100 may also be adjusted. The ballast means 110 and propulsion means 108 of the plurality of modular floating units 100 will allow the plurality of modular floating units 100 to be aligned in a three dimensional domain.

In this example embodiment, lines may also be used between the plurality of modular floating units 100 in accordance with the standard practice of seamanship as a secondary mode of maneuvering the plurality of modular floating units 100 in step 504 for aligning the plurality of modular floating units 100.

To further enhance the efficiency of the aligning step 504, the position monitoring means 112 onboard each of the plurality of modular floating units 100 may be utilized to provide real-time feedback on the position and orientation of each of the plurality of modular floating units 100 so that the operator aligning the plurality of modular floating units 100 may control the ballast means 110 and propulsion means 108 of each of the plurality of modular floating units 100 according to the current position, disposition and orientation of the plurality of modular floating units 100. Therefore, the aligning step 504 may further include the step of monitoring the position and orientation of each of the plurality of modular floating units 100 via position monitoring means 112.

As illustrated in FIG. 3 and FIG. 4, a centralized control means 314, 414 may be provided so that the controlling and monitoring of the ballast means 110, the propulsion means 108, and the position monitoring means 112 may be centrally controlled and monitored. With a centralized control, this will allow the operator to have a better appreciation of the entire process during the step 504 of aligning the plurality of modular floating units 100. Therefore, the aligning step 504 may further include the step of controlling and monitoring the ballast means 110, the propulsion means 108 and the position monitoring means 112 of the plurality of modular floating units 100 via a centralized control means 314, 414.

Furthermore, FIG. 3 and FIG. 4 also shown a communications means 316, 416 for allowing communication between the ballast means 110, the propulsion means 108 and the position monitoring means 112 of the plurality of modular floating units and the centralized control means 314, 414. As described previously, the communication means 316, 416 may be in various configurations. The communication means 316, 416 may enhance the effectiveness of control and monitoring of the ballast means 110, the propulsion means 108 and the position monitoring means 112 of the plurality of modular floating units 100 during the step 504 of aligning the plurality of modular floating units 100. Thus, the step of controlling and monitoring may further include communicating between the ballast means 110, the propulsion means 108 and the position monitoring means 112 of the plurality of modular floating units 100 and the centralized control means 314, 414 via communication means 316, 416.

The step 504*a* of aligning the plurality of modular floating units 100 by adjusting draft and trim of each of the plurality of modular floating units 100 via ballast means 110 and the step 504*b* of aligning the plurality of modular floating units 100 by maneuvering each of the plurality of modular floating units 100 via propulsion means 108 may be achieved based on the experience and ability of the operator, in which the operator will determine the amount of ballasting and maneuvers required to aligned the three or more tunnel thrusters 102, 104, 106 of the plurality of modular floating units 100 from the operator's own experience and knowledge. The amount of ballasting and maneuvers may also be determined based on manual calculations by the operator. Further, it is also possible to determine the amount of ballasting and maneuvers required for aligning the three or more tunnel thrusters 102, 104, 106 of the plurality of modular floating units 100 via computerized means, in which the computerized means may automatically receive inputs from the ballast means 110, the propulsion means 108 and the position monitoring means 112 to perform calculations to determine the amount of ballasting and maneuvers required to aligned the three or more tunnel thrusters 102, 104, 106 of the plurality of modular floating units 100. With the centralized control means 314, 414, the computerized means for determining the amount of ballasting and maneuvers required may be incorporated in the centralized control means 314, 414. Therefore, the method may further include a step for determining the amount of ballasting and maneuvers required for aligning the three or more tunnel thrusters 102, 104, 106 of the plurality of modular floating units 100 via computerized means.

With the plurality of modular floating units 100 aligned, the next step 506 is to operate the at least one of the three or more tunnel thrusters 102, 104, 106 of each of the plurality of modular floating units 100 to generate at least one horizontal pillar of water flow 202, 204, 206. In step 506, at least one of the three or more tunnel thrusters 102, 104, 106 of each of the plurality of modular floating units 100 is operated to generate at least one horizontal pillar of water flow 202, 204, 206, which runs through a series of the at least one of the aligned tunnel thrusters 102, 104, 106 of the plurality of modular floating units 100 such that the at least one horizontal pillar of water flow 202, 204, 206 skewers each of the plurality of modular floating units 100 longitudinally along the longitudinal axis of the at least one of the three or more tunnel thrusters 102, 104, 106 through at least one of the three or more tunnel thrusters 102, 104, 106.

In operating the at least one of the three or more tunnel thrusters 102, 104, 106 to generate at least one horizontal pillar of water flow 202, 204, 206, the at least one of the three or more tunnel thrusters 102, 104, 106 of a modular floating unit 100 on one end of the floating structure 200 is started first. Subsequently, a corresponding one of the three or more tunnel thrusters 102, 104, 106 on an adjacent modular floating unit 100 is started. Following which, corresponding ones of the three or more tunnel thrusters 102, 104, 106 on the following adjacent modular floating units 100 are sequentially started until all the corresponding ones of the three or more tunnel thrusters 102, 104, 106 on all the modular floating units are started. In this way, a pillar of water flow 202, 204, 206 may be generated by the corresponding ones of the three or more tunnel thrusters 102, 104, 106 started and the pillar of water flow 202, 204, 206 may skewer each of the plurality of modular floating units.

For example, referring to FIG. 2, the bow tunnel thrusters 102 of modular floating unit 100*e* may be started first. Water will be sucked into the inlet of bow tunnel thruster 102 of the modular floating unit 100*e*. Bow tunnel thruster 102 of modular floating unit 100*d* may then be started. Water that is pushed out from the outlet of bow tunnel thruster 102 of the modular floating unit 100*e* will be sucked into the inlet of bow tunnel thruster 102 of modular floating unit 100*d* and subsequently pushed out through the outlet of bow tunnel thruster 102 of modular floating unit 100*d*. The sequence of starting the bow tunnel thruster 102 of each of the plurality of modular floating units 100*a-e* continues until all the bow tunnel thrusters 102 of the plurality of modular floating units 100*a-e* are all started. In this manner, a horizontal pillar of water flow 202, which skewers each of the plurality of modular floating units may be generated.

In generating the at least one horizontal pillar of water flow 202, 204, 206, the corresponding ones of the three or more tunnel thrusters 102, 104, 106 of the plurality of modular floating units 100 may be synchronized with each other to operate such that they are operating substantially at the same water flow rate. Water flow rate is the volume of water that is flowing through the tunnel thrusters 102, 104, 106 over a period of time and may be measured in terms of cubic meters per second ($m^3/s$). The water flow rate is dependent on the size and shape of the propellers of the three or more tunnel thrusters 102, 104, 106, as well as the revolution speed of the propellers. With the corresponding ones of the three or more tunnel thrusters 102, 104, 106 generating substantially the same water flow rate in series, a horizontal pillar of water flow 202, 204, 206 may be generated, which may be continuous and may skewer the plurality of modular floating units 100 such that the plurality of modular floating units 100 may be stabilized so as to be analogous to a single floating structure.

With the floating structure 200 formed by the plurality of modular floating units 100, the plurality of modular floating units 100 may then be configured to be used as a single floating structure such as floating terminals, floating airports, floating wind/solar power plants, floating industrial facilities, floating habitation facilities, floating storage facilities, floating military bases etc.

To stabilize and maintain a floating structure 200 formed by a plurality of modular floating units 100 lined abreast with the three or more tunnel thrusters 102, 104, 106 aligned, generating at least one horizontal pillar of water flow 202, 204, 206 for connecting the plurality of modular floating units 100 such that the at least one horizontal pillar of water flow 202, 204, 206 skewers each of the plurality of modular floating units 100 may stabilize and maintain the plurality of modular floating units 100 such that they form a floating, structure 200. With the at least one horizontal pillar of water flow 202, 204, 206 skewering and connecting the plurality of modular floating units 100, the floating structure 200 formed may react to the prevailing wind, current and weather conditions substantially as a single floating structure.

Depending on the prevailing wind, current and weather conditions, the floating structure 200 formed by a plurality of modular floating units 100 may then be turned to a favourable orientation and be maintained in the favourable orientation until the prevailing wind, current or weather conditions change. When the prevailing wind, current or weather conditions changes, the floating structure 200 formed by a plurality of modular floating units may be turned again to a new favourable orientation.

Figure 6:
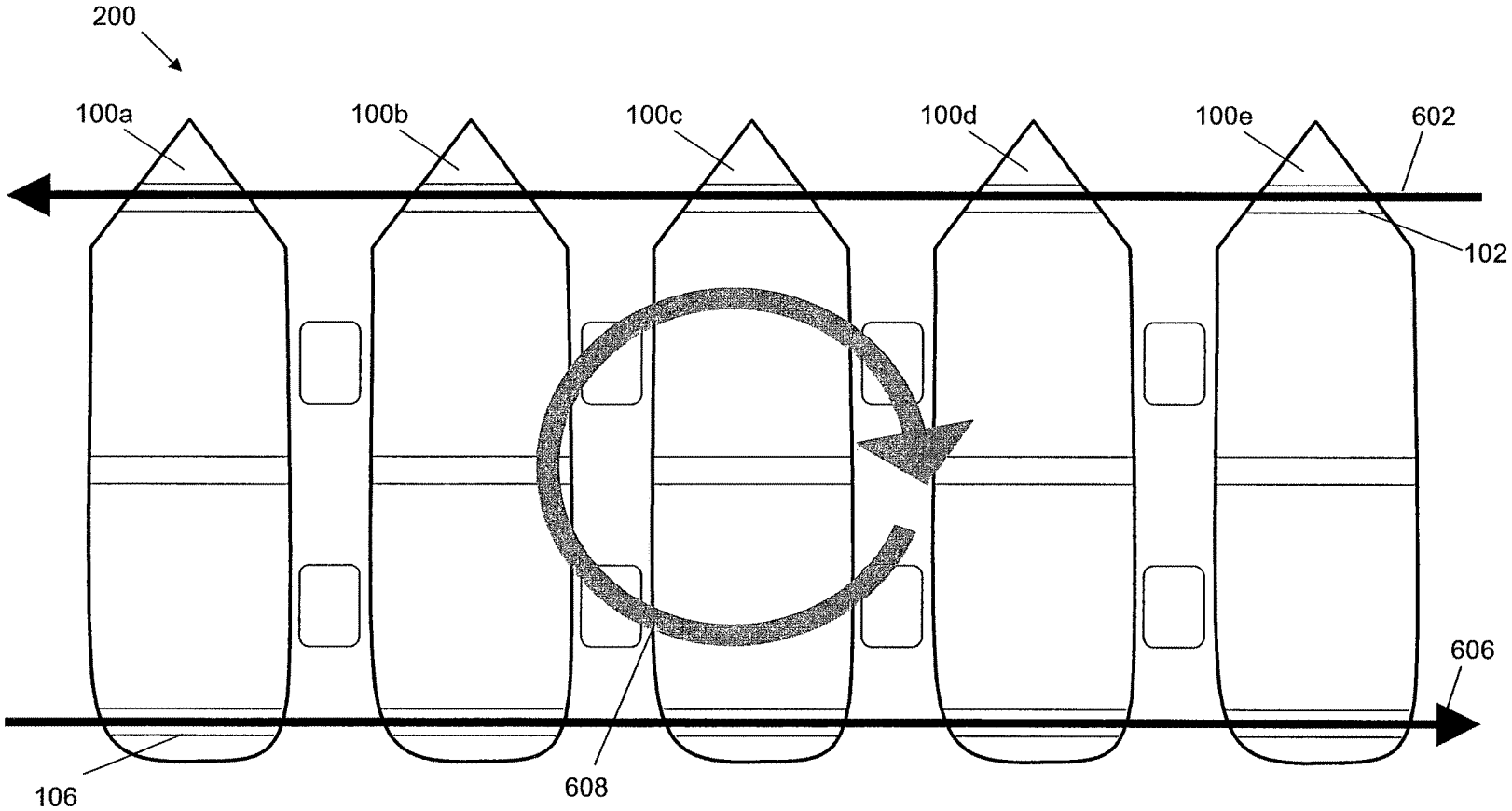
FIG. 6 shows a top view of a floating structure according to an example embodiment of the present invention with a different configuration and combination of horizontal pillars of water flow as shown in FIG. 2.

FIG. 6 shows a top view of a floating structure 200 in accordance to an embodiment of the present invention turning in a clockwise direction 608. In order to change the orientation by turning the floating structure 200 formed by a plurality of modular floating units 100*a-e*, a first horizontal pillar of water flow 602 is generated near the bow of each of the modular floating units. The first horizontal pillar of water flow 602 may be generated by operating the bow tunnel thrusters 102 of each of the plurality of modular floating units 100*a-e*. A second horizontal pillar of water flow 606 is concurrently generated near a stern of each of the plurality of modular floating units 100*a-e*. The second horizontal pillar of water flow 606 may be generated by operating the stern tunnel thrusters 106 of each of the plurality of modular floating units 100*a-e* such that the first horizontal pillar of water flow 602 is in an opposite direction from the second horizontal pillar of water flow 606. In this way, the floating structure 200 formed by the plurality of modular floating units 100*a-e* may be turned as a single floating body.

In order to maintain the orientation and position of the floating structure 200 formed by the plurality of modular floating units 100*a-e* under a prevailing wind, current or weather conditions, the plurality of modular floating units 100*a-e* may generate horizontal pillars of water flow in the manner as shown in FIG. 2.

In order to maintain the orientation and position of the floating structure 200 formed by the plurality of modular floating units 100*a-e*, a first horizontal pillar of water flow 202 is generated near the bow of each of the modular floating units. The first horizontal pillar of water flow 202 may be generated by operating the bow tunnel thrusters 102 of each of the plurality of modular floating units 100*a-e*. A second horizontal pillar of water flow 204 is concurrently generated substantially in a midship of each of the plurality of modular floating units 100*a-e*. The second horizontal pillar of water flow 204 may be generated by operating the midship tunnel thrusters 104 of each of the plurality of modular floating units 100*a-e*. At the same time a third horizontal pillar of water flow 206 is generated near a stem of each of the plurality of modular floating units 100*a-e*. The second horizontal pillar of water flow 206 may be generated by operating the stern tunnel thrusters 106 of each of the plurality of modular floating units 100*a-e*. As shown in FIG. 2, the first horizontal pillar of water flow 202 and the third horizontal pillar of water flow 206 are in the same direction, whereas the second horizontal pillar of water flow 204 is in an opposite direction from that of the first horizontal pillar of water flow 202 and the third horizontal pillar of water flow 206.

In this example embodiment, the water flow rate of the first horizontal pillar of water flow 202 may be substantially the same as the water flow rate of the third horizontal pillar of water flow 206. However, the water flow rate of the second horizontal pillar of water flow 204 may be substantially equivalent, depending on the sea and weather condition, to the combined total water flow rate of the first horizontal pillar of water flow 202 and the third horizontal pillar of water flow 206. The relationship may be further represented by the following equation, water flow rate at tunnel thruster 102+water flow rate at tunnel thruster 106≈water flow rate at tunnel thruster 104

In this way, the forces acting on both sides of the floating structure 200 formed by the plurality of modular floating units 100 may be equalized and the floating structure 200 may remain in an equilibrium position, therefore resulting in the floating structure 200 maintaining its orientation and position.

It is understood that the number of horizontal pillars of water flow 202, 204, 206, the water flow rate for each horizontal pillars of water flow 202, 204, 206 and the direction of each of the horizontal pillars of water flow 202, 204, 206 may be varied depending on the prevailing wind, current and weather conditions to allow the floating structure 200 formed by the plurality of modular floating units 100 to turn to a favourable orientation or to maintain in a favourable orientation.

Figure 7:
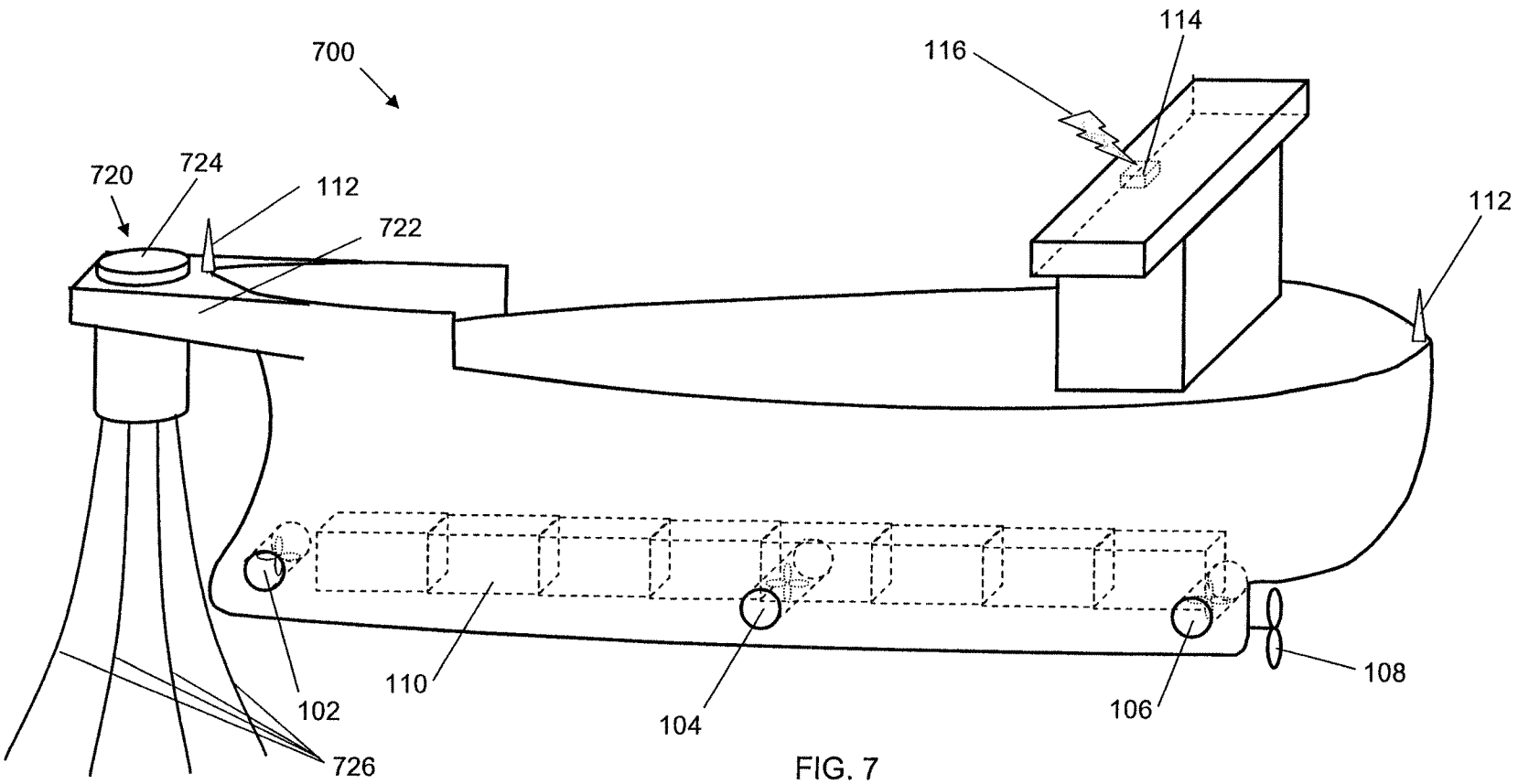
FIG. 7 shows a perspective view of a modular floating unit of a floating structure according to another example embodiment of the present invention.

FIG. 7. shows a perspective view of a modular floating unit 700 of a floating structure according to another embodiment of the present invention. In addition to all the features of the modular floating unit 100 as shown in FIG. 1, the modular floating unit 700 of the floating structure as shown in FIG. 7 further includes an offshore mooring system 720. As illustrated in FIG. 7, the offshore mooring system 720 is an external turret mooring system. The external turret mooring system 720 include a turret casing 722 which extends from the bow of the modular floating unit 700 and a turret 724 coupled to the turret casing 722 via a bearing arrangements (not shown). Mooring lines 726 then run from the turret 724 to the seabed, connecting the turret 724 to the seabed in a manner in which the turret 724 becomes geostatic. The bearing arrangements in turn allow the modular floating unit 700 to rotate about the turret 724, thus allowing the modular floating unit 700 to freely weathervane around the turret 724. It is understood that the offshore mooring system 720 may also be an internal turret mooring system, disconnectable turret mooring system or any other known offshore mooring system. FIG. 7 is provided by way of an example only.

The inclusion of an offshore mooring system 720 may advantageously allow the modular floating unit 700 to be configured for use as a floating production, storage and offloading (FPSO) unit.

Figure 8:
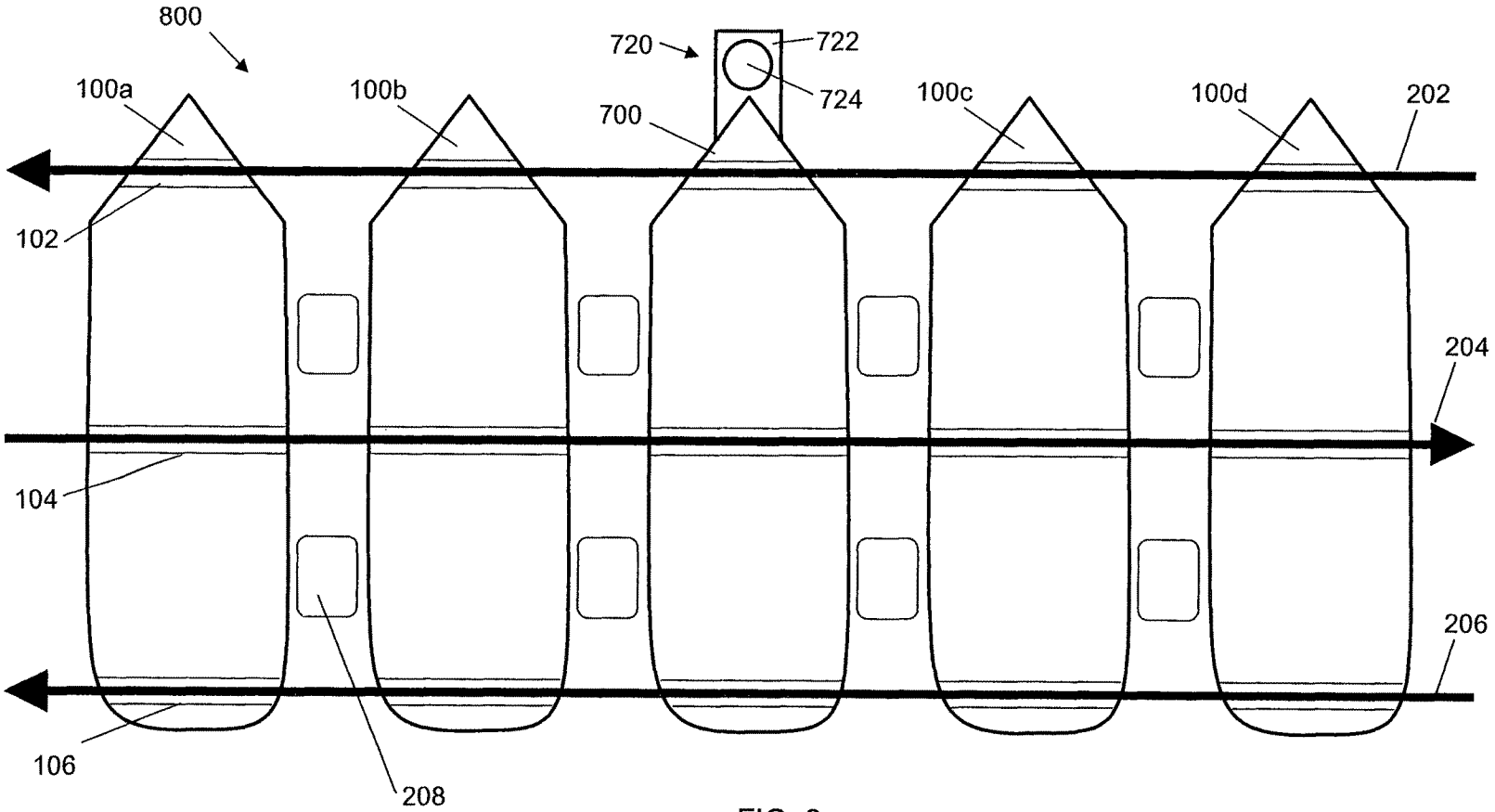
FIG. 8 shows a top view of a floating structure according to another example embodiment of the present invention.

FIG. 8 shows a top view of a floating structure 800 according to another embodiment of the present invention. As shown in FIG. 8, the floating structure 800 is formed by a plurality of modular floating units 100*a-d*, 700 lined abreast and spaced apart by fenders 208. The floating structure 800 is substantially similar to the floating structure 200, except that at least one modular floating unit 700, which include an offshore mooring system 720, may be disposed in the middle of the aligned plurality of modular floating units 100*a-d*, 700. The floating structure 800 formed may have similar characteristics as floating structure 200 and may be formed by similar method. It is understood that the number of modular floating unit 700 with an offshore mooring system 720 and the disposition of modular floating unit 700 may varied. FIG. 8 is provided by way of an example and not limitation.

With the inclusion of modular floating unit 700, the method of forming the floating structure 800 may include a step of mooring modular floating unit 700 in addition to the method of forming floating structure 200 as described above. The step of mooring modular floating unit 700 of floating structure 800 may take place before step 504 of aligning the plurality of modular floating units 100*a-d*, 700. Advantageously, with the modular floating unit 700 moored, the remaining plurality of modular floating units 100*a-d* may take alignment from the moored modular floating unit 700 during step 504 of aligning the plurality of modular floating units 100*a-d*, 700.

In another embodiment, the modular floating unit 700 may be moored after step 504 when the plurality of modular floating units 100*a-d*, 700 are aligned.

In yet another embodiment, floating structure 800 may be formed by the method of forming floating structure 200 as described by step 502 thru 506. The additional step of mooring modular floating unit 700 may be added after step 506 in which at least one of the three or more tunnel thrusters 102, 104, 106 of the plurality of modular floating units 100*a-d*, 700 are operated to generate at least one horizontal pillar of water flow 202, 204, 206 to skewer each of the plurality of modular floating units 100*a-d*, 700 of floating structure 800. Advantageously, in this embodiment, the floating structure 800 formed may be maneuvered to a location where the floating structure 800 is required and subsequently the step of mooring modular floating unit 700 will fixed the floating structure 800 to the location where the floating structure 800 is required.

With the modular floating unit 700 moored, advantageously, the floating structure 800 may be allowed to weathervane about the mooring turret 724 depending on the prevailing wind, current and weather. The at least one horizontal pillar of water flow 202, 204, 206 may also be operated to rotate the floating structure 800 about the mooring turret 724. Another advantage of including modular floating unit 700 is that the floating structure 800 may be configured for use as a floating production, storage and offloading facilities.

The advantages of the embodiments of the present invention are that a stable, cost effective, modular, expandable and easy to assemble offshore floating structure 200, 800 may be formed by the plurality of modular floating units 100, 700 as described above. Further, the floating structure 200, 800 may or may not be moored to the seabed and it is possible for each of the plurality of modular floating units 100, 700 to disassemble easily when pending hostile weather is approaching. Thus it can be seen that floating structure 200, 800 has been provided which eliminates the issues hindering the expansion of usage of offshore floating structures.

It will be appreciated by a person skilled in the art that numerous variations and/or modifications may be made to the present invention as shown in the specific embodiments without departing from the spirit or scope of the invention as broadly described. The present embodiments are, therefore, to be considered in all respects to be illustrative and not restrictive.

The invention claimed is:

1. A method for forming a floating structure, the method comprising:

providing a plurality of modular floating units including three or more tunnel thrusters;

aligning the plurality of modular floating units wherein each of the three or more tunnel thrusters of each of the plurality of modular floating units are aligned to each of a corresponding three or more tunnel thrusters on an adjacent modular floating unit; and operating at least one of the three or more tunnel thrusters of each of the plurality of modular floating units to generate at least one horizontal pillar of water flow, wherein the at least one horizontal pillar of water flow skewers each of the plurality of modular floating units longitudinally through one of the three or more tunnel thrusters thereof.

2. The method as claimed in claim 1 wherein the aligning the plurality of modular floating units further comprises:

aligning the plurality of modular floating units by adjusting draft and trim of each of the plurality of modular floating units via ballast means; and aligning the plurality of modular floating units by maneuvering each of the plurality of modular floating units via propulsion means.

3. The method as claimed in claim 2 further comprising monitoring the position and orientation of each of the plurality of modular floating units via position monitoring means.

4. The method as claimed in claim 3 further comprising controlling and monitoring the ballast means, the propulsion means and the position monitoring means of the plurality of modular floating units via a centralized control means.

5. The method as claimed in claim 4, wherein the controlling and monitoring comprises communicating between the ballast means, the propulsion means and the position monitoring means of the plurality of modular floating units and the centralized control means via communications means.

6. The method as claimed in claim 4, further comprising determining the amount of ballasting and maneuvers required for aligning the tunnel thrusters via computerized means.

7. The method as claimed in claim 1, wherein the operating at least one of the three or more tunnel thrusters to generate at least one horizontal pillar of water flow further comprises first starting at least one of the three or more tunnel thrusters of a modular floating unit on one end of the floating structure, subsequently starting a corresponding one of the three or more tunnel thrusters on an adjacent modular floating unit, and continue starting corresponding ones of the three or more tunnel thrusters on the following adjacent modular floating units until all the corresponding ones of the three or more tunnel thrusters on all the modular floating units are started, wherein the pillar of water flow generated by the corresponding ones of the three or more tunnel thrusters skewers each of the plurality of modular floating units.

8. The method as claimed in claim 1, wherein the operating at least one of the three or more tunnel thrusters to generate at least one horizontal pillar of water flow further comprises synchronizing the corresponding ones of the three or more tunnel thrusters of the plurality of modular floating units generating the horizontal pillar of water flow to operate substantially at the same water flow rate.

9. The method as claimed in claim 1, further comprising mooring one of the plurality of modular floating units.

10. The method as claimed in claim 1, further comprising configuring the plurality of modular floating units for use as a single floating structure.

11. A floating structure comprising:

a plurality of modular floating units, wherein:

three or more tunnel thrusters of a first modular floating unit of the plurality of modular floating units are aligned to corresponding three or more tunnel thrusters of a second modular floating unit of the plurality of modular floating units that is adjacent to the first modular floating unit, and the three or more tunnel thrusters and the corresponding three or more tunnel thrusters are configured to generate horizontal pillars of water flow that skewer each of the plurality of modular floating units to connect the plurality of modular floating units.

12. The floating structure as claimed in claim 11, wherein the plurality of modular floating units further comprises:

ballast means for adjusting the draft and trim of the plurality of modular floating units; and propulsion means for maneuvering the plurality of modular floating units.

13. The floating structure as claimed in claim 12, wherein the plurality of modular floating units further comprises position monitoring means for monitoring the position of the plurality of modular floating units.

14. The floating structure as claimed in claim 13 further comprising centralized control means for centralized controlling and monitoring of the ballast means, the propulsion means and the position monitoring means.

15. The floating structure as claimed in claim 14 further comprising communication means for communicating between the centralized control means and each of the plurality of modular floating units.

16. The floating structure as claimed in claim 11, wherein at least one of the plurality of modular floating units further comprises offshore mooring system.

17. A method comprising:

stabilizing a plurality of modular floating units lined abreast, wherein:

the plurality of modular floating units comprises:

a first modular floating unit comprising a first tunnel thruster; and a second modular floating unit comprising a second tunnel thruster; and the stabilizing comprises:

generating, by at least the first tunnel thruster and the second tunnel thruster, a horizontal pillar of water flow that flows along a longitudinal axis shared by the first tunnel thruster and the second tunnel thruster, through each of the plurality of modular floating units.

18. The method as claimed in claim 17 further comprising:

turning the plurality of floating units to a favorable orientation taking into consideration the prevailing wind, current and weather conditions, and maintaining the plurality of floating units in the favorable orientation.

19. The method as claimed in claim 18, wherein the maintaining the plurality of floating units further comprises:

generating a first horizontal pillar of water flow near a bow of each of the plurality of modular floating units, generating a second horizontal pillar of water flow substantially in a midship of each of the plurality of modular floating units; and generating a third horizontal pillar of water flow near a stern of each of the plurality of modular floating units, and wherein the first and the third horizontal pillar of water flow are in the same direction, and wherein the second horizontal pillar of water flow is in an opposite direction from the first and the third horizontal pillar of water flow.

* * * * *